US006318439B1

(12) United States Patent
Matsubara

(10) Patent No.: US 6,318,439 B1
(45) **Date of Patent: *Nov. 20, 2001**

(54) BLIND WITH PORTIONS SELECTABLE FOR INTRODUCING OR SHIELDING LIGHT

(75) Inventor: Michio Matsubara, Tokyo (JP)

(73) Assignee: The Akasaka Kogei Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/531,502

(22) Filed: Mar. 21, 2000

(30) Foreign Application Priority Data

Mar. 24, 1999 (JP) ..... 11-079651

(51) Int. Cl.[7] ..... E06B 3/48
(52) U.S. Cl. ..... 160/115
(58) Field of Search ..... 160/115, 176.1 R, 160/168.1 R, 107, 114, 113, 173 R, 177 R

(56) References Cited

U.S. PATENT DOCUMENTS 2,706,522 * 4/1955 White ..... 160/115
2,794,499 * 6/1957 White ..... 160/115
4,487,243 * 12/1984 Debs ..... 160/168.1 R
5,485,874 * 1/1996 Whitmore ..... 160/115
5,845,691 * 12/1998 Gaines ..... 160/115

* cited by examiner

*Primary Examiner*—David M. Purol
(74) *Attorney, Agent, or Firm*—Arent Fox Kintner Plotkin & Kahn, PLLC

(57) ABSTRACT

A blind having plural rudder cords each of which is formed of a pair of vertical strings and plural lateral strings joining the vertical strings together, and each of which is brought down from a head box in the vertical direction, and plural pieces of slats extending horizontally on the lateral strings of the rudder cords, retained in parallel with one another and adapted to be turned by the operations of the rudder cords, whereby the blind is opened and closed, comprising openings provided in the portions of each of the slats which are in the vicinity of the rudder cords, and drawing strings which are capable of being pulled up, and which are brought down from the head box along the rudder cords, inserted through the openings of the slats and made connectable at lower end portions thereof to the portions of either one of the respective pairs of vertical strings of the rudder cords which are in positions of an arbitrary height.

8 Claims, 12 Drawing Sheets

BLIND WITH PORTIONS SELECTABLE FOR INTRODUCING OR SHIELDING LIGHT

BACKGROUND OF THE INVENTION

This invention relates to a horizontal blind opened and closed by turning slats thereof, and more particularly to a blind enabling a light introducing position thereon to be selected in the vertical direction, and, moreover, a boundary between light introducing and shielding portions thereof to be set freely.

In a horizontal blind of the related art, rudder cords are brought down in the vertical direction from left and right portions of a head box fixed to an upper portion of a window frame, and plural pieces of horizontally extending slats are retained in parallel with one another at predetermined intervals by these left and right rudder cords, the plural slats in this condition being opened and closed by turning the same simultaneously by operating the rudder cords.

When it is possible to select a light introducing position on a blind in the vertical direction in order to prevent an image on a picture frame of a computer from becoming hard to be seen due to the light entering an office and the like through a window thereof, or the information shown on such a picture frame from leaking through the window, an ideal environment in which a necessary part only of the inside of the office is lighted with the other thereof shaded can be obtained.

To meet such a requirement, a blind disclosed in Japanese Utility Model Publication No. 3517/1987 is provided with two systems of independently operable rudder cords brought down from a head box, and upper and lower groups of slats fixed to these two systems of rudder cords are operated independently, whereby a light introducing position on the blind can be selected in the vertical direction.

However, since this blind has a structure in which the upper and lower groups of slats are fixed to two systems of rudder cords and operated independently of each other, a boundary between light introducing and shielding portions of the blind cannot be varied as necessary. Namely, an environment in which an image on a picture frame of a computer becomes hard to be seen due to the light entering an office through a window thereof and leaks out through the window differs in various ways depending upon the design of the office and the arrangement of desks, so that the blind in which the boundary between the light introducing and shielding portions are fixed cannot attain the ideal lighting suited to the condition in each office.

SUMMARY OF THE INVENTION

According to an aspect of the present invention, a blind is provided which enables a light introducing position thereon to be selected in the vertical direction, and, moreover, a boundary between light introducing and shielding portions thereof to be set freely.

In order to achieve the foregoing object, a blind of the present invention is provided which has plural rudder cords each of which is formed of a pair of vertical strings and plural lateral strings joining the vertical strings together, and each of which is brought down from a head box in the vertical direction, and plural pieces of slats extending horizontally on the lateral strings of the rudder cords, retained in parallel with one another and adapted to be turned by the operations of the rudder cords, whereby the blind is opened and closed, comprising openings provided in the portions of each of the slats which are in the vicinity of the rudder cords, and drawing strings which are capable of being pulled up, and which are brought down from the head box along the rudder cords, inserted through the openings of the slats and made connectable at lower end portions thereof to the portions of either one of the respective pairs of vertical strings of the rudder cords which are in positions of an arbitrary height.

According to the present invention, drawing strings capable of being pulled up are brought down from a head box along rudder cords, and lower end portions of the drawing strings are joined to the portions of either one of the respective pairs of vertical strings of the rudder cords which are in positions of an arbitrary height, whereby the blind as a whole is opened and closed by the operations of the rudder cords with only the slats that are on the lower side of the mentioned position of an arbitrary height rendered able to be partially opened and closed by the drawing operations of the drawing strings. Therefore, a light introducing position can be selected in the vertical direction of the blind.

Since the lower end portions of the drawing strings are made connectable with respect to the vertical strings of the rudder cords, a boundary between the light introducing and shielding portions can be set freely by varying the string connecting position.

Moreover, since each slat is provided with openings in the portions thereof which are in the vicinity of the rudder cords with drawing strings inserted through the openings, the drawing strings expand outward in the openings as bending points at joint portions thereof with respect to the rudder cords. Therefore, the drawing strings draw during their pull-up operations the slats toward widthwise intermediate portions thereof to enable sharp turning actions of the slats to be made. When the drawing strings are inserted through the openings provided in the slats, the existence of these strings does not spoil the external appearance of the blind.

As a device for pulling up the drawing strings, a driving unit which has drive shafts supported in the head box and mounted with plural reels for winding the drawing strings therearound, and which is adapted to turn the drive shafts in an arbitrary direction may be provided.

According to the present invention, it is possible to bring down two systems of drawing strings along rudder cords, and join the lower end portions of these drawing strings to different vertical strings of the rudder cords. When the lower end portions of the drawing strings are joined to the portions of different vertical strings of the rudder cords which are in the positions of the same height, the direction in which the slats are inclined can be selected arbitrarily on the basis of the operations of the two systems of drawing strings. When the lower end portions of the two systems of drawing strings are joined to the portions of different vertical strings of the rudder cords which are in positions of different heights, a boundary between the light introducing and shielding portions can be selected arbitrarily on the basis of the operations of the two systems of drawing strings.

When two systems of drawing strings are provided, as the device for pulling up the drawing strings, a driving unit which has one drive shaft supported in a head box and provided with plural reels for winding the two systems of drawing strings therearound in opposite directions, and which is adapted to turn the drive shaft in an arbitrary direction, may be provided. A driving unit which has two drive shafts supported in a head box and provided with plural reels for winding the two systems of drawing strings therearound separately, and which is adapted to turn the drive shafts in an arbitrary direction respectively, may also be provided.

BRIEF DESCRIPTION OF THE DRAWINGS

FIGS. 4A and 4B illustrate connecting members for drawing strings with respect to rudder cords, wherein:

FIG. 4A is a side view of a hook; and

FIG. 4B is a side view of a clip;

FIGS. 5A and 5B show operations for opening and closing the blind of FIG. 1, wherein:

FIG. 5A is a side view showing a principal portion in a fully opened condition; and FIG. 5B is a side view showing the condition of a principal portion in which a lower part is closed with an upper part left opened;

FIGS. 6A and 6B show another mode of operations for opening and closing the blind of FIG. 1, wherein:

FIG. 6A is a side view showing a principal portion in a fully opened condition; and FIG. 6B is a side view showing the condition of a principal portion in which a lower part is closed with an upper part left opened;

FIGS. 7A and 7B illustrate operations for opening and closing the blind of FIG. 1, wherein:

FIG. 7A is a side view of a principal portion showing a fully closed condition; and FIG. 7B is a side view of a principal portion showing the condition in which a lower part is opened with an upper part left closed;

FIGS. 8A and 8B shows still another mode of operations for opening and closing the blind of FIG. 1, wherein:

FIG. 8A is a side view of a principal portion showing a fully closed condition; and FIG. 8B is a side view of a principal portion showing the condition in which a lower part is opened with an upper part left closed.

FIGS. 11A and 11B show operations for opening and closing the blind of FIG. 10, wherein:

FIG. 11A is a side view of a principal portion showing a fully opened condition; and FIG. 11B is a side view of a principal portion showing the condition in which a central part alone is closed with upper and lower parts left opened;

FIGS. 12A and 12B show operations for opening and closing the blind of FIG. 10, wherein:

FIG. 12A is a side view of a principal portion in a fully closed condition; and FIG. 12B is a side view of a principal portion showing the condition in which a central part alone is opened with upper and lower parts left closed;

DETAILED DESCRIPTION OF THE PREFERRED EMBODIMENTS

Figure 1:
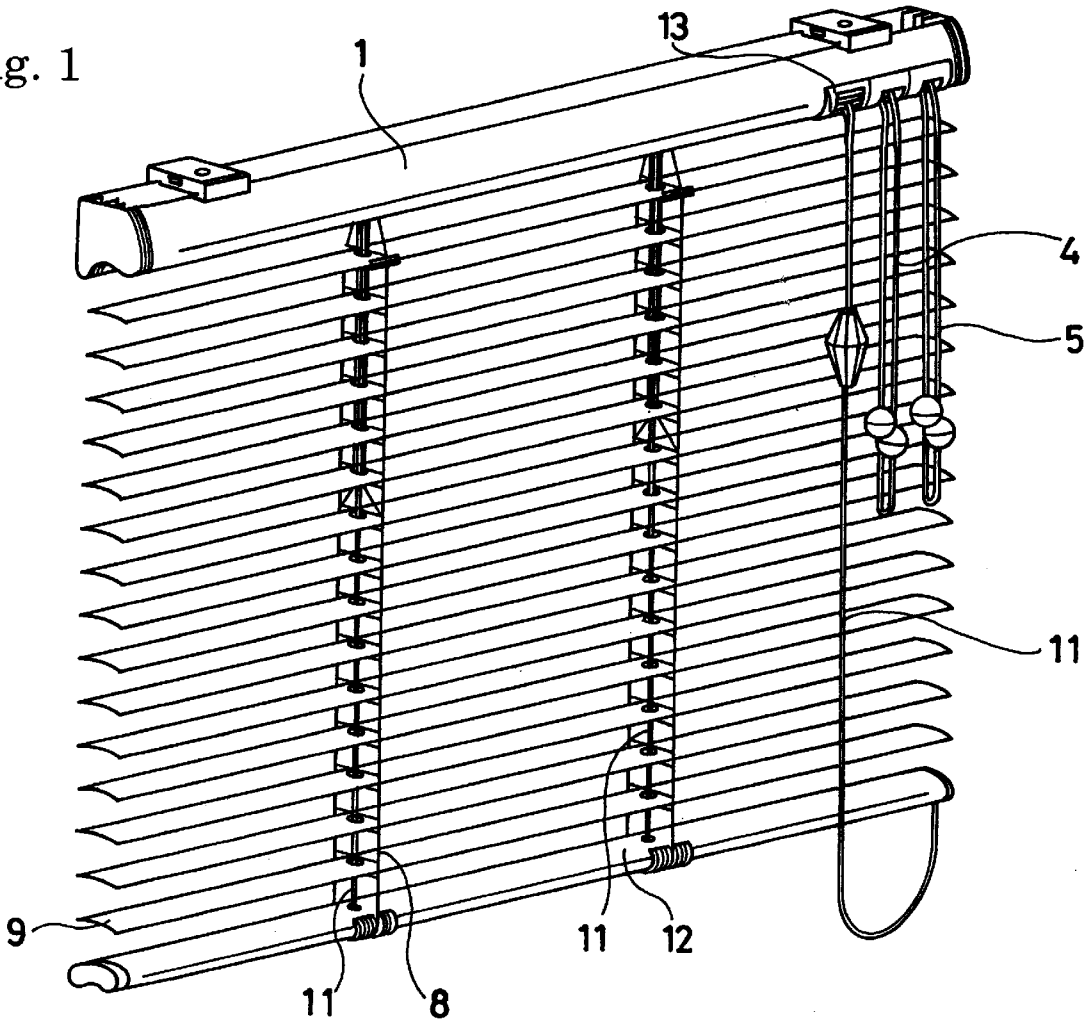
FIG. 1 is a perspective view showing a mode of embodiment of the blind according to the present invention.
Figure 2:
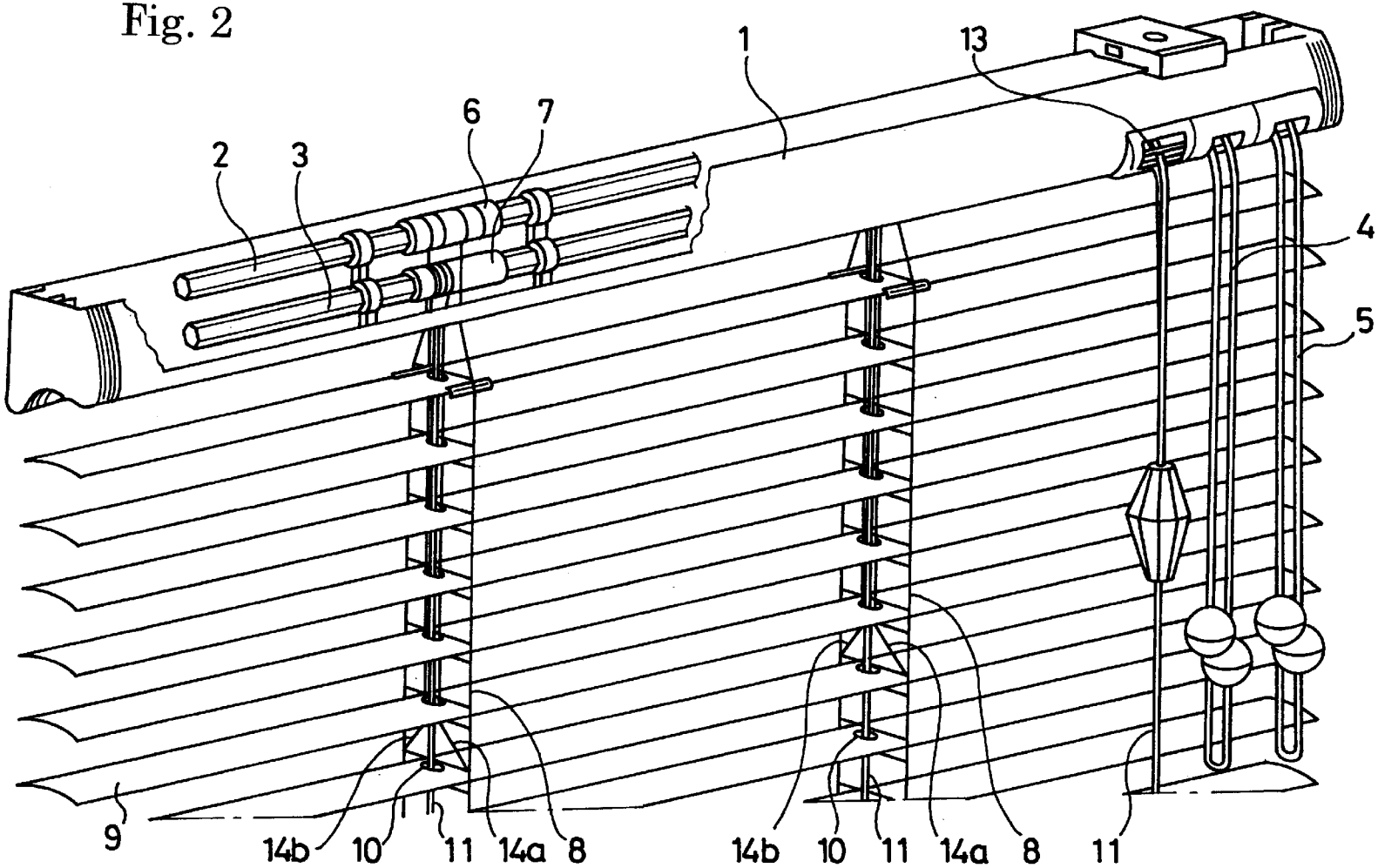
FIG. 2 is a partially cutaway view in perspective showing a principal portion of the blind of FIG. 1.
Figure 3:
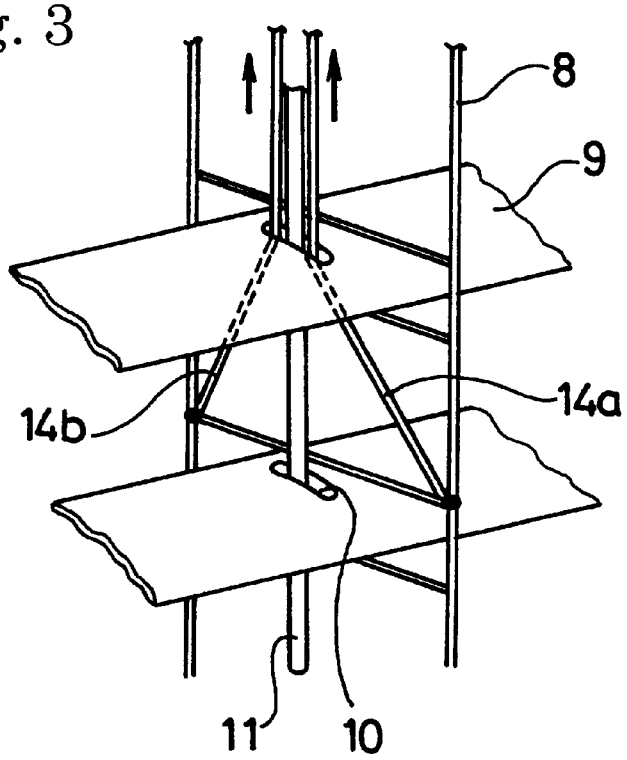
FIG. 3 is a perspective view showing a more limited principal portion of the blind of FIG. 2.

FIGS. 1 to 3 illustrate a blind formed of an embodiment of the present invention. In FIGS. 1 to 3, a head box 1 is provided therein with drive shafts 2, 3 extending in the lengthwise direction thereof and supported therein in parallel with each other. Pulleys (not shown) are mounted on end portions of the drive shafts 2, 3 respectively so that the drive shafts 2, 3 are rotated freely in both directions by operating opening and closing cords 4, 5. These pulleys and opening and closing cords constitute a driving unit for the drive shafts.

Left and right reels 6, 6 are mounted on the drive shaft 2, and an upper end portion of a rudder cord 8 is joined to each reel 6. The rudder cord 8 includes a pair of vertical strings, and plural lateral strings connecting the vertical strings together. On these lateral strings of the rudder cord 8, plural horizontally extending slats 9 are retained in parallel with one another.

A pair of vertical strings of each rudder cord 8 are wound around the reel 6 in the opposite directions. Accordingly, when the drive shaft 2 is rotated in a predetermined direction, one vertical string of the rudder cord 8 is taken up, and the other unwound, so that the plural slats 9 are turned at once in the same direction around horizontal axes thereof with the angle of inclination thereof varied.

Each slat 9 is provided in the portions thereof which are in the vicinity of the rudder cords 8 with elliptic openings 10 having longer diameters extending in the widthwise direction thereof. In these openings 10, slat lifting cords 11 extending downward from the head box 1 are inserted. The lower end portions of the slat lifting cords 11 are joined with those of the rudder cords 8 to a bottom rail 12. The upper end portions of the slat lifting cords 11 are drawn out to the outside of the head box 1 via stoppers 13.

The drive shaft 3 is mounted with left and right reels 7, 7, to which upper end portions of two drawing strings 14*a*, 14*b* are joined respectively. These two drawing strings 14*a*, 14*b* are wound in the opposite directions around the reels 7. Therefore, when the drive shaft 3 is rotated in a predetermined direction, an operation for drawing up either one of the drawing strings 14*a*, 14*b* can be carried out. These drawing strings 14*a*, 14*b* extend from the head box 1 in the downward direction along the rudder cords 8, and are inserted in the openings 10 of the slats 9. The length of the portions of the drawing strings 14*a*, 14*b* which are suspended from the head box 1 can be varied by regulating the length thereof by which the drawing strings 14*a*, 14*b* are wound around the reels 7. When the drawing strings 14*a*, 14*b* are arranged so that they are moved by independent drive shafts and reels, the length of the suspended portions of the drawing strings 14*a*, 14*b* can be varied simply on the basis of an amount of rotation of each reel.

Figure 4A:
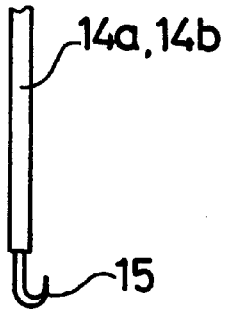
Figure 4B:
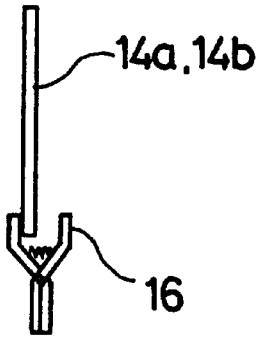

As shown in FIG. 3, the drawing strings 14*a*, 14*b* are extended so that the lower end portions thereof can be joined freely to the portion of either one of a pair of vertical strings of the rudder cords 8 which is in a position of an arbitrary height. In this mode of embodiment, two systems of drawing strings 14*a*, 14*b*, which are pulled up alternately as mentioned above, are joined to the portions of different vertical strings of the rudder cords 8 which are in positions of the same height. A device for connecting these drawing strings 14*a*, 14*b* to the rudder cords 8 is not specially limited. For example, the lower end portions of the drawing strings 14*a*, 14*b* can be sewn on the vertical strings of the rudder cords 8 in compliance with a customer's request. A simple detachable connecting member, such as a hook 15 shown in FIG. 4A and a clip 16 shown in FIG. 4B may be fixed to the lower end portions of the drawing strings 14*a*, 14*b*.

In order to operate the blind formed as described above, the stopper 13 is disengaged, and the lifting cords 11 are moved, whereby the bottom rail 12 is brought down so as to arrange the plural slats 9 horizontally in parallel with one another at predetermined intervals as shown in FIG. 1. The opening and closing cord 4 is then operated to rotate the drive shaft 2 and turn the plural slats 9 around the horizontal axes thereof, whereby the operations for opening and closing the blind as a whole are carried out.

Figure 5A:
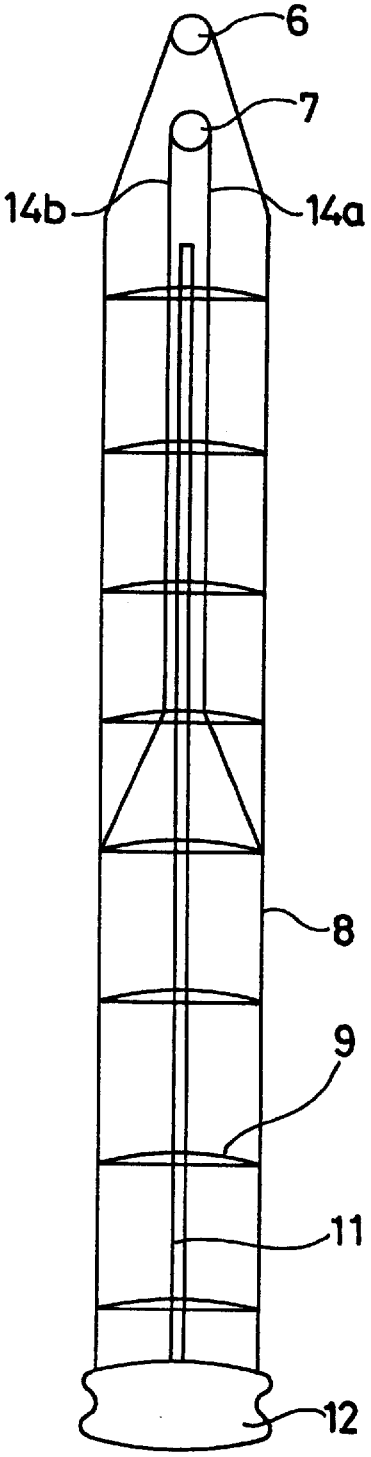
Figure 5B:
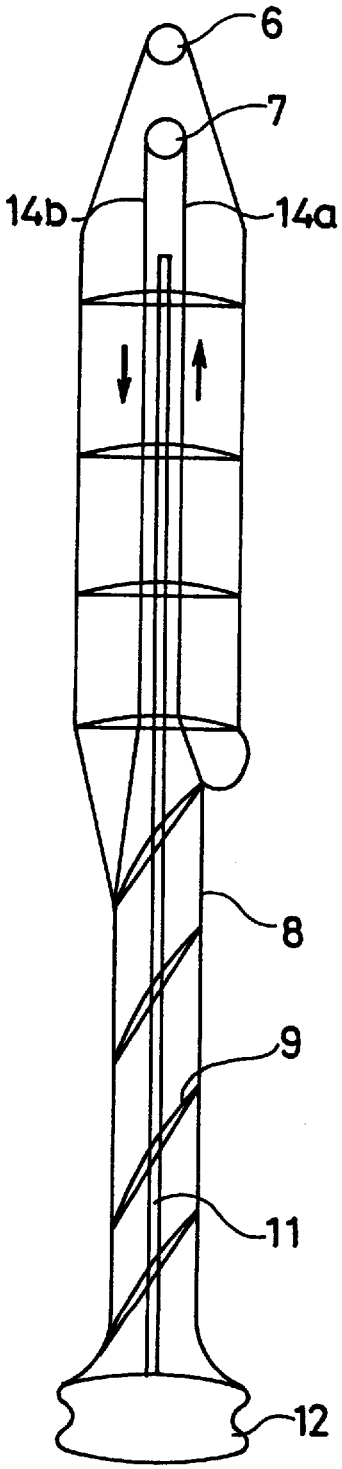
Figure 6A:
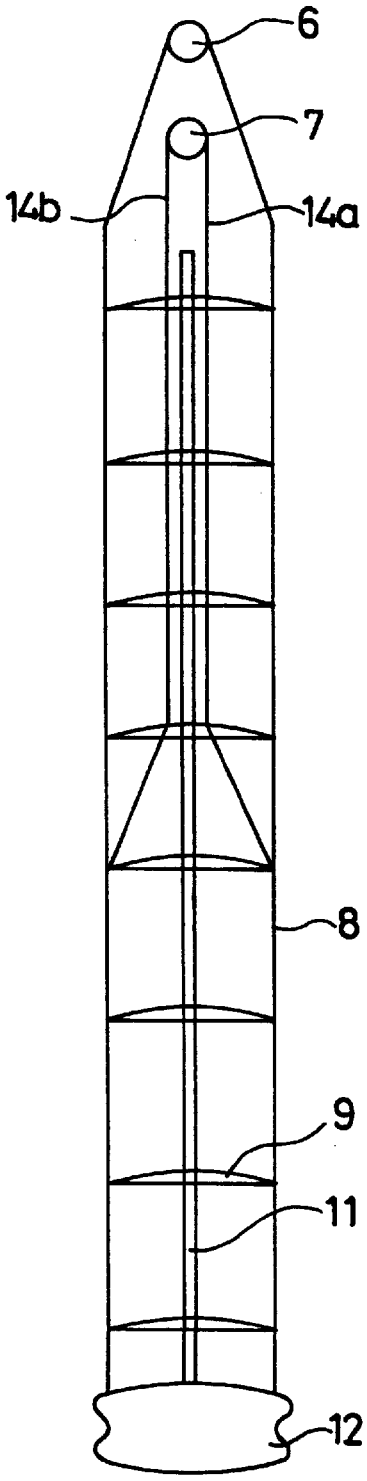
Figure 6B:
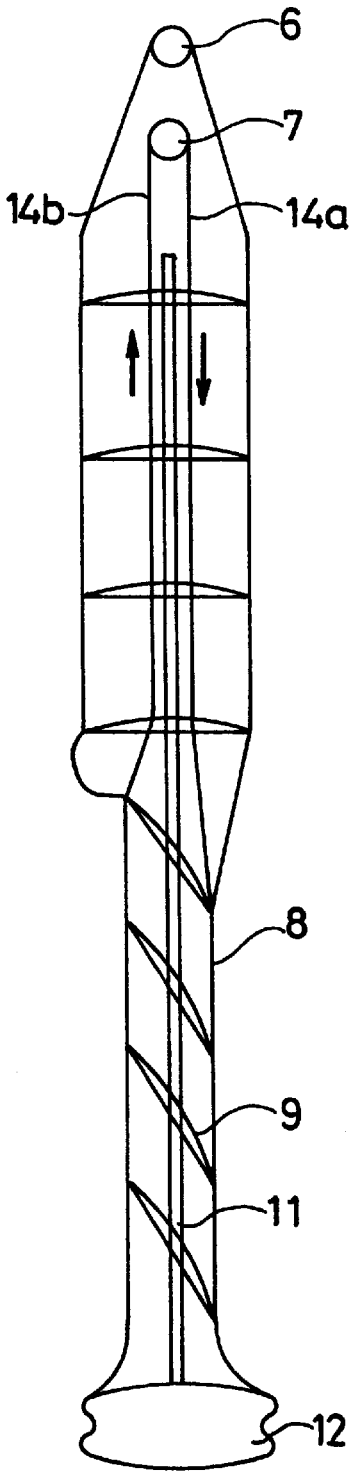

In order to partially open and close the blind, the drive shaft 3 is rotated by operations of the opening and closing cord 5, whereby the drawing strings 14*a*, 14*b* may be operated suitably. For example, in order to open an upper portion of the blind with a lower portion thereof put in a closed condition, an operation shown in FIG. 5 or 6 is carried out. Namely, after the blind as a whole is put in an opened condition as shown in FIG. 5A, only the slats 9 that are on the lower side of a position in which the drawing string 14*a* and rudder cord 8 are joined together are put in a closed condition, by pulling up the drawing string 14*a* as shown in FIG. 5B; or, after the blind as a whole is put in an opened condition as shown in FIG. 6A, only the slats 9 that are on the lower side of a position in which the drawing string 14*b* and rudder cord 8 are joined together are put in a closed condition by pulling up the drawing string 14*b* as shown in FIG. 6B.

Figure 7A:
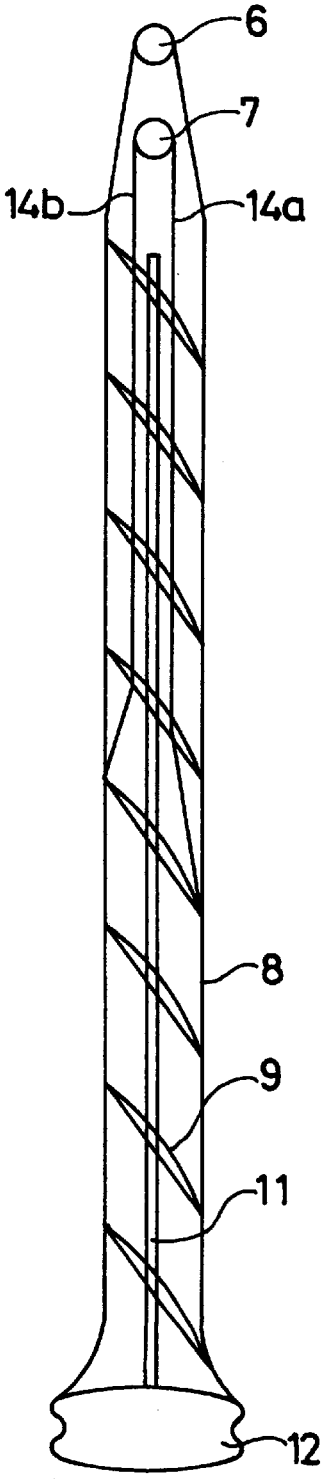
Figure 7B:
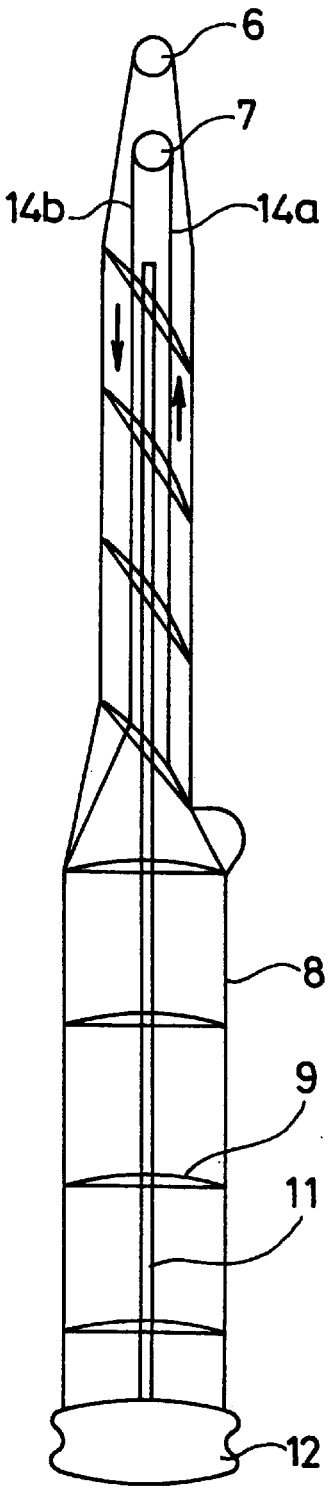
Figure 8A:
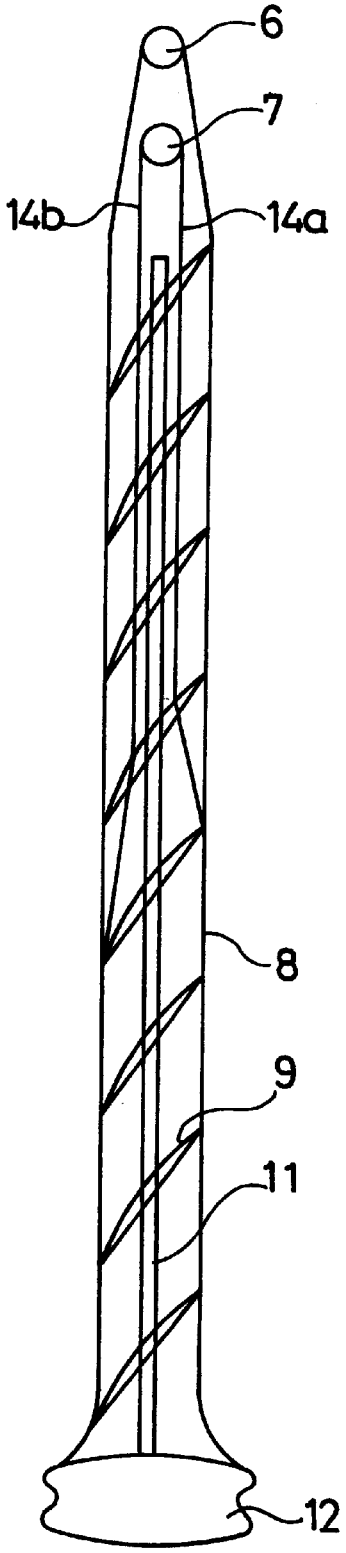
Figure 8B:
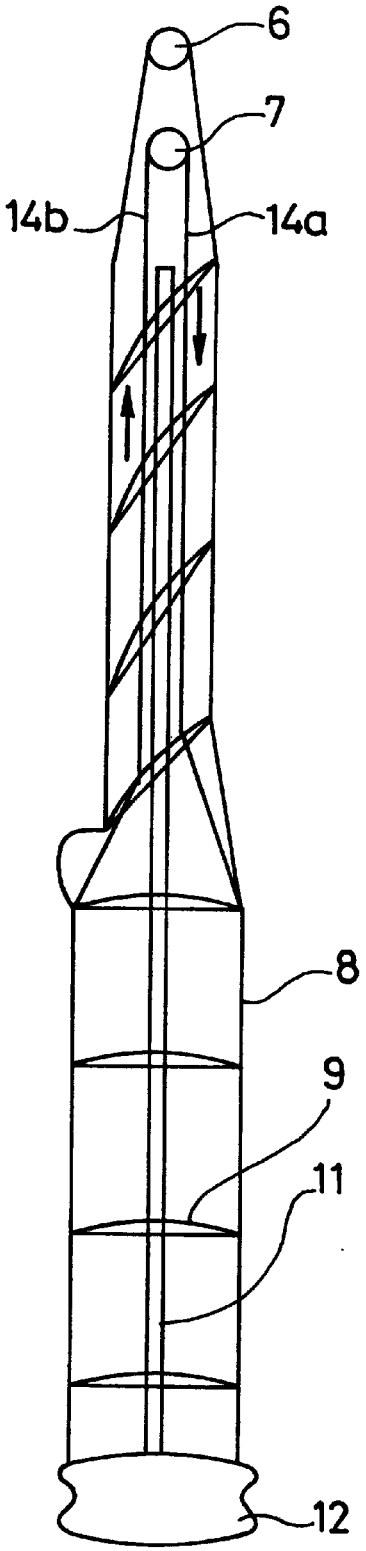

In order to put the upper portion of the blind in a closed condition with the lower portion thereof put in an opened condition, an operation shown in FIG. 7 or 8 is carried out. Namely, after the blind as a whole is put in a closed condition by turning the slats 9 so that the joint portion of the drawing string 14*a* is in a lower position as shown in FIG. 7A, only the slats 9 that are on the lower side of a position in which the drawing string 14*a* and rudder cord 8 are joined together are put in an opened condition; or, after the blind as a whole is put in a closed condition by turning the slats 9 so that the joint portion of the drawing string 14*b* is in a lower position as shown in FIG. 8A, only the slats 9 that are on the lower side of a position in which the drawing string 14*b* and rudder cord 8 are joined together are put in an opened condition by pulling up the drawing string 14*b* as shown in FIG. 8B.

Since both the drawing strings 14*a*, 14*b* enable the partial opening and closing of the blind, the provision of either one of them may serve the purpose. When two systems of drawing strings 14*a*, 14*b* joined to different vertical strings are provided just as in this mode of embodiment, the direction in which the slats 9 are inclined for effecting the partial opening and closing of the blind can be set suitably. For example, referring to FIGS. 5 to 8, the operations of FIGS. 5 and 8 may be carried out when the blind receives light from the left side of the drawings, and the operations of FIGS. 6 and 7 when the blind receives light from the right side of the drawings.

As described above, the drawing strings 14*a*, 14*b* are brought down from the head box 1 along the rudder cords 8, and inserted through the openings 10 of the slats 9, and the lower end portions of the drawing strings are joined to the portion of either one of each pair of vertical strings which has an arbitrary height. Therefore, the opening and closing of the blind as a whole are done by the operation of the rudder cords 8, while the blind can be partially opened and closed by the pull-up operation of the drawing strings 14*a*, 14*b*.

Since the lower end portions of the drawing strings 14*a*, 14*b* are formed so that they can be joined freely to the vertical strings of the rudder cords 8, a boundary between the light introducing and shielding portions can be set freely by only varying the position in which these strings are joined together. Therefore, it becomes possible to take in a suitable quantity of light while eliminating inconveniences, such as the occurrence of the difficulty in looking at the images on a picture frame of a computer due to the light, and the leakage of the displayed information through a window, by arbitrarily selecting the light introducing and shielding portions on the basis of the design of an office and the arrangement of desks therein.

Moreover, in the above-described blind, the drawing strings 14*a*, 14*b* are inserted in the openings 10 provided in the slats 9, so that the drawing strings 14*a*, 14*b* become possible to expand outward in the openings 10 as bending points. Therefore, when these drawing strings 14*a*, 14*b* are pulled up, the edge portions of the slats 9 are drawn toward the openings 10, and the turning movements of the slats 9 based on the operations of the drawing strings 14*a*, 14*b* are made smoothly as shown in FIGS. 5 to 8. When the drawing strings 14*a*, 14*b* are disposed on the outer side of the slats 9, the turning movements of the slats 9 become imperfect since the slats 9 are only moved up even if these drawing strings 14*a*, 14*b* are pulled up to a maximum extent. Furthermore, the drawing strings 14*a*, 14*b* inserted in the openings 10 of the slats 9 hardly extend to the outside thereof, so that the external appearance of the blind is not spoiled.

Figure 9:
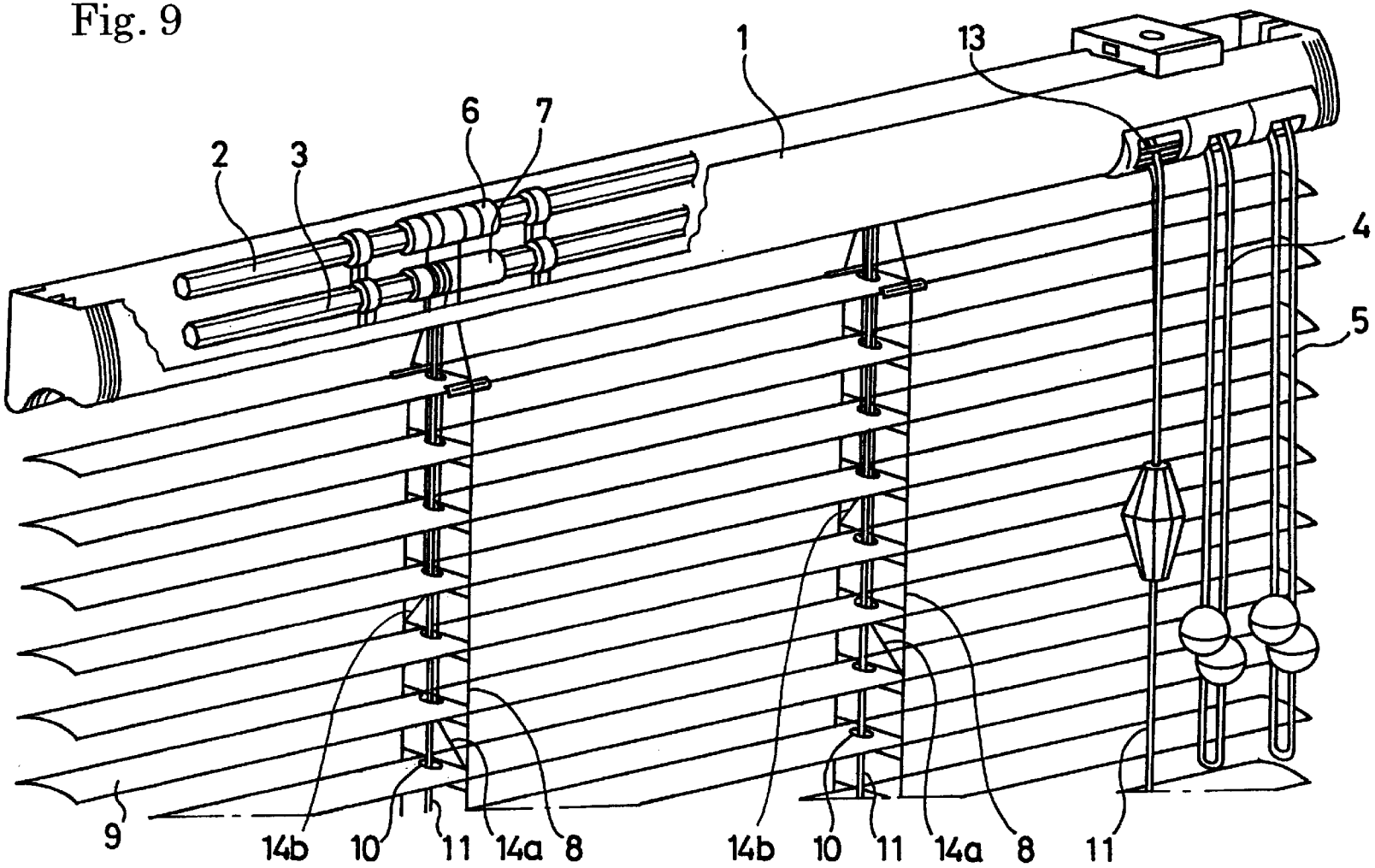
FIG. 9 is a partially cutaway view in perspective showing a principal portion of another mode of embodiment of the blind according to the present invention.

FIG. 9 illustrates another mode of embodiment of the blind according to the present invention. This mode of embodiment differs from the previously-described mode of embodiment in that two systems of drawing strings 14*a*, 14*b* adapted to be pulled up alternately are joined to the portions of different vertical strings of the rudder cords 8 which are in positions of different heights.

In the blind thus formed, partially opening and closing operations can be carried out by the same operations as in the previously-described mode of embodiment. Moreover, since the position in which the drawing string 14*a* and rudder cord 8 are joined together and that in which the drawing string 14*b* and rudder cord 8 are joined together are different from each other, a boundary between light introducing and shielding portions can be selected arbitrarily on the basis of the operations of the two systems of drawing strings 14*a*, 14*b*.

Figure 10:
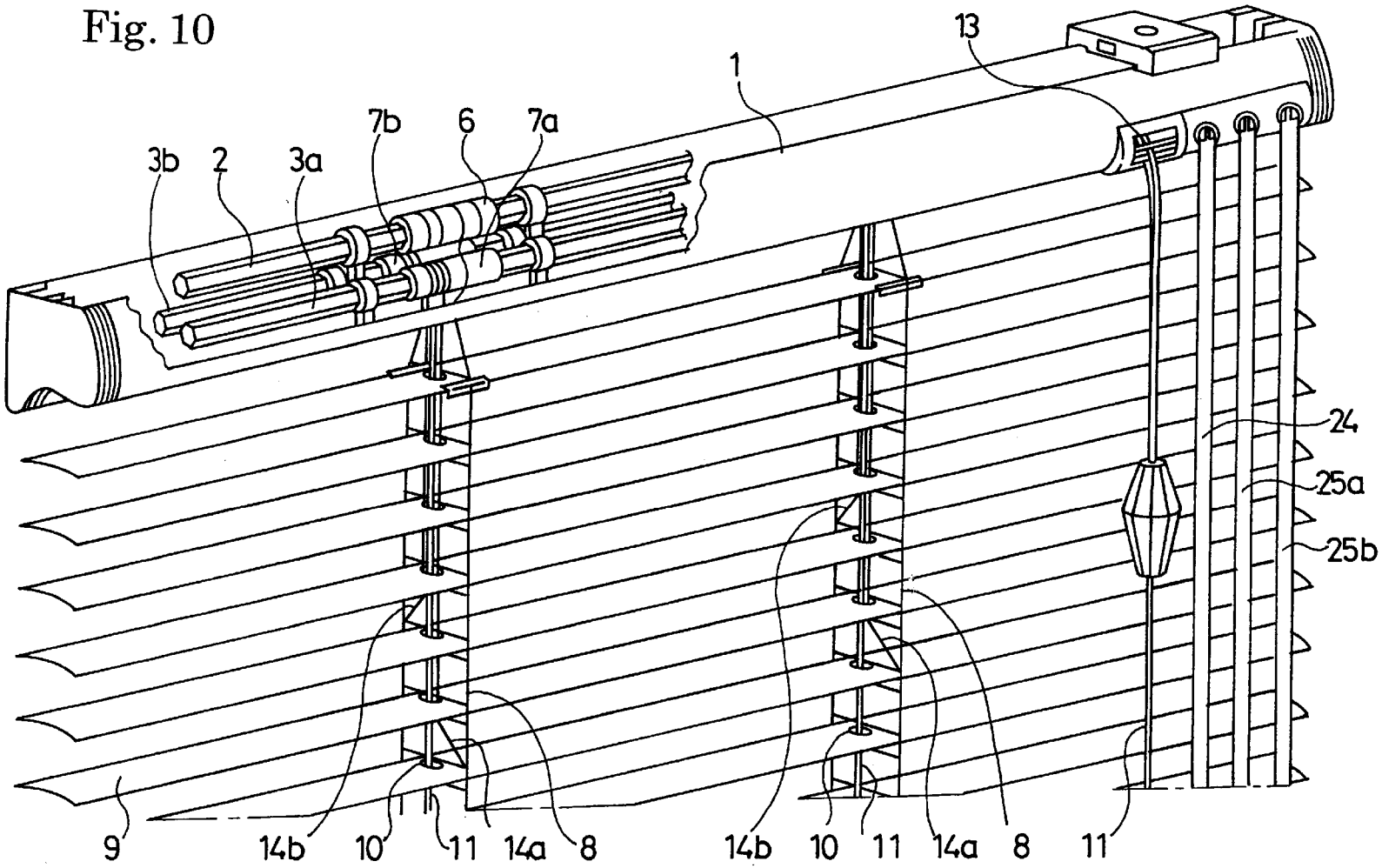
FIG. 10 is a partially cutaway view in perspective showing a principal portion of still another mode of embodiment of the blind according to the present invention.

FIG. 10 illustrates still another mode of embodiment of the blind according to the present invention. The parts of this blind which are identical with those of each of the previously-described embodiments will be designated by the same reference numerals, and detailed descriptions thereof will be omitted. As shown in FIG. 10, drive shafts 3*a*, 3*b*, which are used to operate drawing strings 14*a*, 14*b* respectively, in addition to a drive shaft 2 for operating rudder cords 8, are supported in parallel with each other in a head box 1. These drive shafts 2, 3*a*, 3*b* are mounted with worm gears (not shown) at their respective end portions. When opening and closing rods 24, 25*a*, 25*b* joined pivotably to the worm gears are operated, the drive shafts 2, 3*a*,

3*b* are rotated freely in both directions. These worm gears and opening and closing rods constitute a driving unit for the drive shafts.

The drive shaft 3*a* is mounted with left and right reels 7*a*, 7*a*, to which upper end portions of the drawing strings 14*a* are joined respectively. Therefore, when the drive shaft 3*a* is rotated in a predetermined direction, an operation for pulling up the drawing strings 14*a* can be carried out. The drawing strings 14*a* extend from the head box 1 in the downward direction along rudder cords 8, and are inserted in openings 10 of slats 9.

The drive shaft 3*b* is mounted with left and right reels 7*b*, 7*b*, to which upper end portions of drawing strings 14*b* are joined respectively. Therefore, when the drive shaft 3*b* is rotated in a predetermined direction, an operation for pulling up the drawing strings 14*b* can be carried out. The drawing strings 14*b* extend from the head box 1 in the downward direction along the rudder cords 8, and are inserted in the openings 10 of the slats 9.

The lower end portions of the drawing strings 14*a*, 14*b* are formed so that they can be joined freely to the portions of either one of a pair of vertical strings of the rudder cords 8 which are in positions of an arbitrary height. In this mode of embodiment, the two systems of drawing strings 14*a*, 14*b*, which are adapted to be pulled up independently as mentioned above, are joined to the portions of different vertical strings of the rudder cords 8 which are in positions of different heights.

Figure 11A:
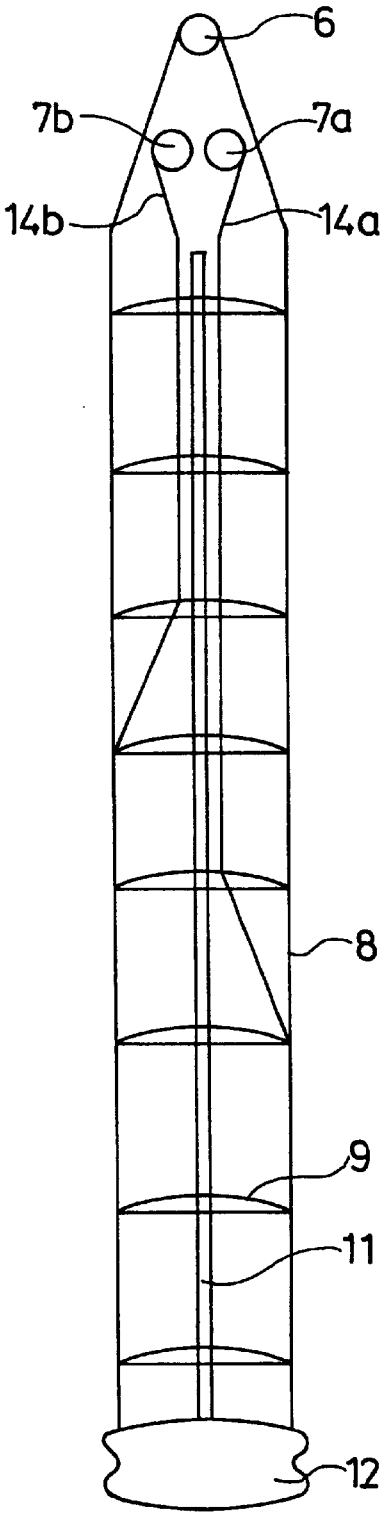
Figure 11B:
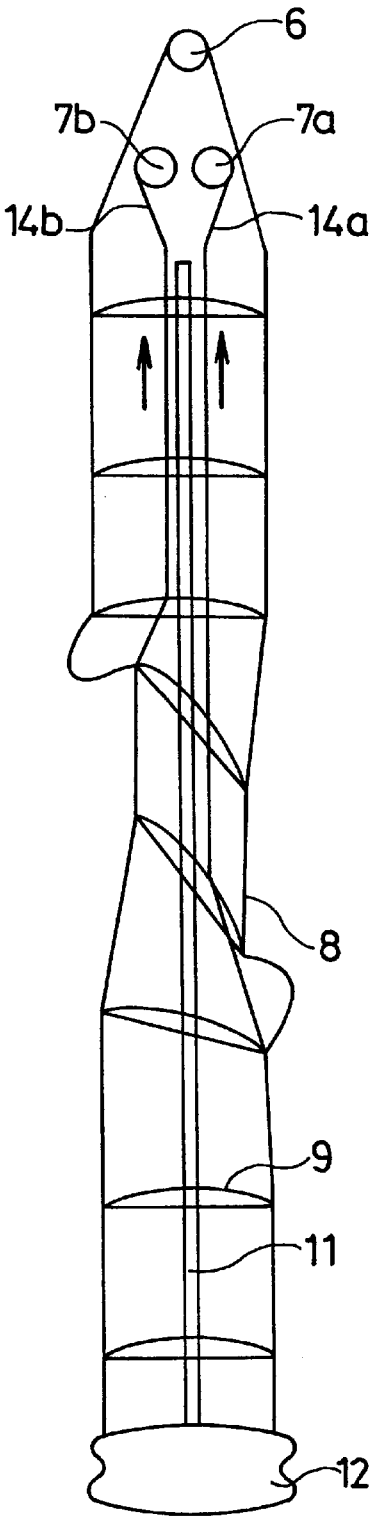
Figure 12A:
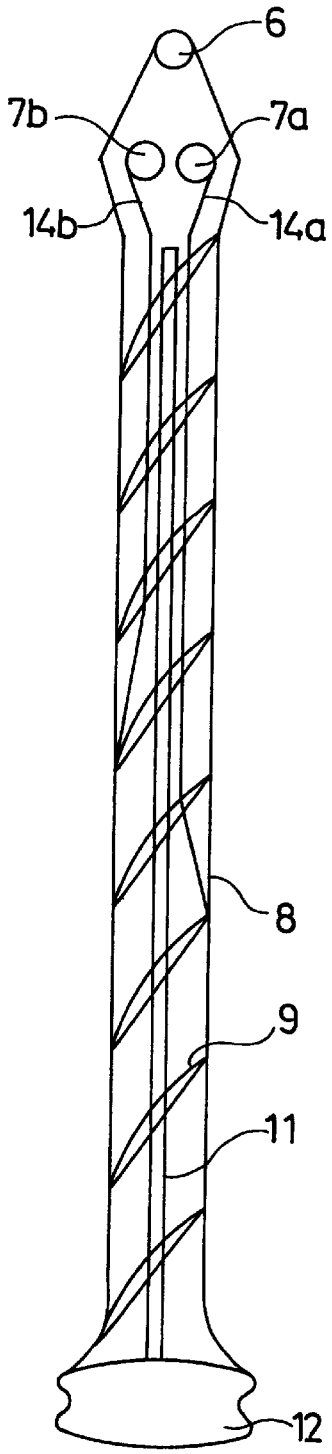
Figure 12B:
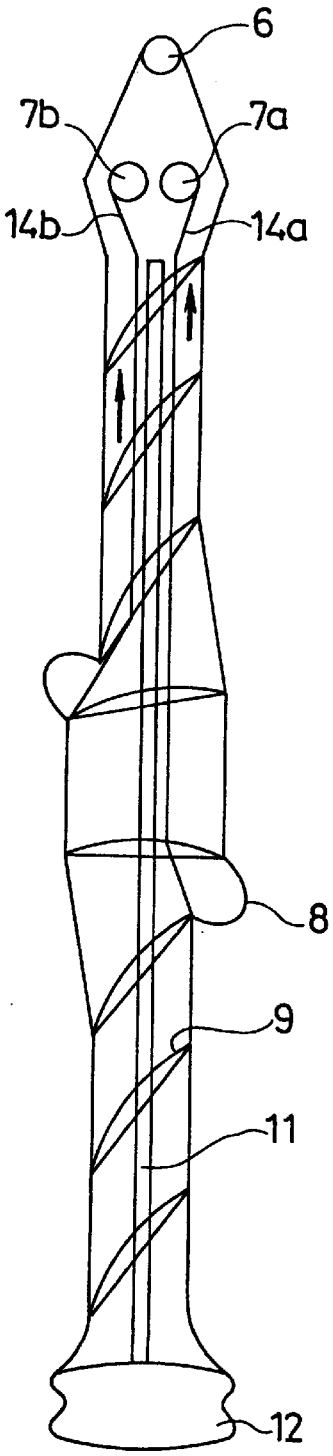

The blind formed as described above permits still more complicated operations to be carried out as compared with the previously-described modes of embodiments. For example, in order to put upper and lower portions of the blind in an opened condition with only a central portion thereof put in a closed condition, operations shown in FIG. 11 are carried out. Namely, after the blind as a whole is put in an opened condition as shown in FIG. 11A, the drawing strings 14*a*, 14*b* are all pulled up as shown in FIG. 11B, whereby only the slats 9 that are between a position in which the drawing string 14*a* and rudder cord 8 are joined together and a position in which the drawing string 14*b* and rudder cord 8 are joined together are put in a closed condition. In order to put the upper and lower portions of the blind in a closed condition with only the central portion thereof put in an opened condition, operations shown in FIG. 12 are carried out. Namely, after the blind as a whole is put in a closed condition as shown in FIG. 12A, both of the drawing strings 14*a*, 14*b* are pulled up as shown in FIG. 12B, whereby only the slats 9 that are between a position in which the drawing string 14*a* and rudder cord 8 are joined together and a position in which the drawing string 14*b* and rudder cord 8 are joined together are put in an opened condition.

When lower end portions the two systems of drawing strings 14*a*, 14*b* are thus joined to the portions of different vertical strings of rudder cords 8 which are in positions of different heights with the two systems of drawing strings 14*a*, 14*b* set independently operable, the selection of light introducing and shielding portions can be carried out in more complicated manner so as to meet a demand for the attainment of partial light shielding in an office. The sizes of the light introducing portion and light shielding portion can be set arbitrarily on the basis of the positions in which the drawing strings 14*a*, 14*b* are joined to the rudder cord 8.

In the above-described modes of embodiments, a device having a pulley mounted on an end portion of a drive shaft, and an opening and closing cord passed around the pulley, or a device having a worm gear provided on an end portion of a drive shaft, and a rod connected to the worm gear is used as a driving unit for the drive shaft but the driving unit is not limited to these mechanisms.

Figure 13:
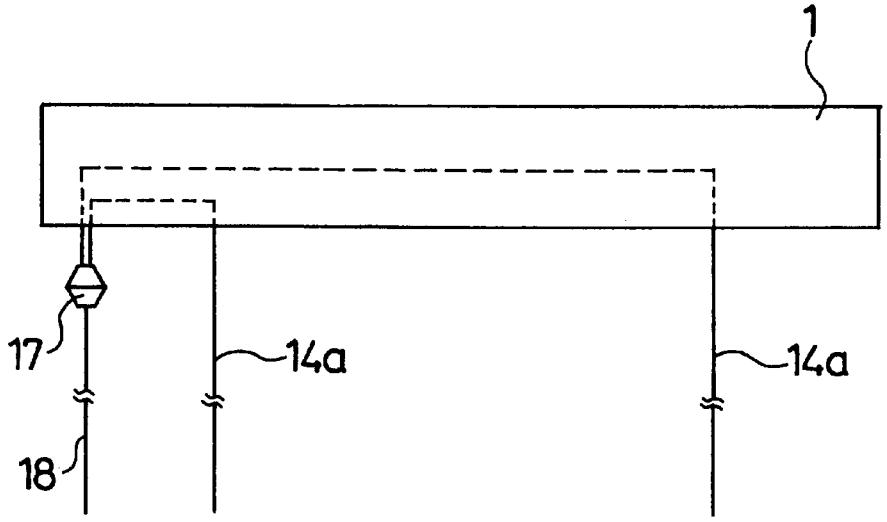
FIG. 13 is a side view showing a principal portion of a modified example of a pull-up unit for pulling up drawing strings in the blind according to the present invention.
Figure 14:
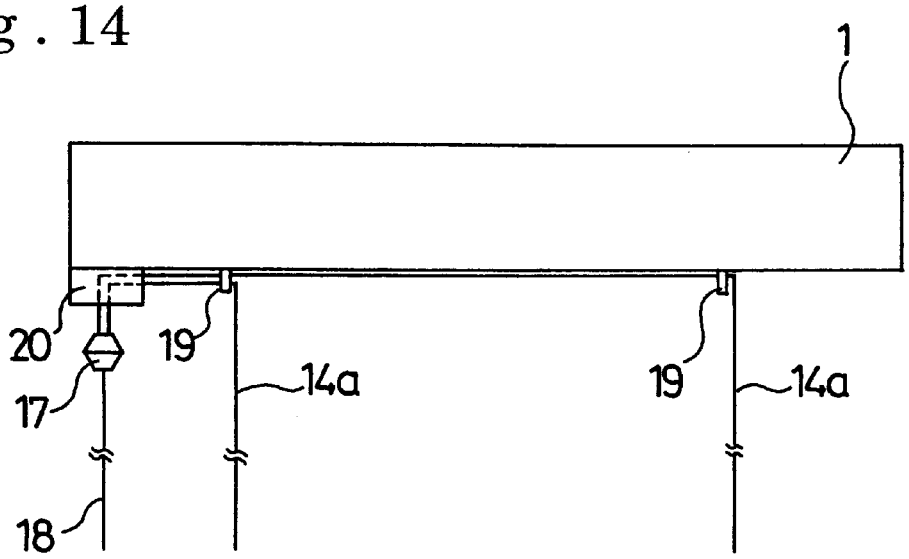
FIG. 14 is a side view showing a principal portion of another modified example of the pull-up unit for pulling up drawing strings in the blind according to the present invention.

The device for pulling up the drawing strings may also be formed more simply than those used in the above-described modes of embodiments. For example, as shown in FIG. 13, this device may be formed by bringing down drawing strings 14*a*(14*b*) from plural portions of a head box 1, drawing out upper end portions of the drawing strings 14*a* to the outside of the head box 1, bundling the resultant upper end portions by a coupling member 17 and connecting the same end portions to a opening and closing cord 18, and setting the opening and closing cord 18 ready to be pulled down. In this case, it is necessary that the drawing strings 14*a* pulled down be made freely engageable with respect to the head box 1. This device may be formed otherwise as shown in FIG. 14, i.e., by fixing ring-shaped or hook-like guide members 19 to plural portions of an outer part of a head box 1, bringing down drawing strings 14*a* (14*b*) from the guide members 19, guiding upper end portions of these drawing strings 14*a* into an operating box 20 fixed to an outer portion of the head box 1, bundling these drawing strings by a coupling member 17 and connecting the same to an opening and closing cord 18, and setting the opening and closing cord 18 ready to be pulled down. In this case, it is necessary that the drawing strings 14*a* be made freely engageable with respect to the operating box 20.

What is claimed is:

1. A blind having a plurality of rudder cords with each being formed of a pair of vertical strings and a plurality of lateral strings joining the vertical strings together and each of the vertical strings extending downwardly from a head box in a vertical direction, and a plurality of slats extending horizontally on the lateral strings of the rudder cords, retained in parallel with one another and adapted to be turned by operating the rudder cords to open and close the blind, the blind comprising:

openings formed in portions of each slat in a vicinity of the rudder cords forming a series of vertically-aligned openings in the plurality of slats; and a plurality of drawing strings capable of being pulled and extending downwardly from the head box along the rudder cords, one drawing string inserted into and extending through the series of the openings in each one of the slats and at least one other drawing string inserted into and extending through only selected sequential ones of the series of the openings in less than all of the slats and connected at a lower end portion thereof to a portion of either one of the respective pairs of vertical strings of the rudder cords in positions of a selected height above a lowermost slat.

2. A blind according to claim 1, wherein the head box is provided with a drive shaft supported therein and mounted with a plurality of reels around which the drawing strings are wound, and a driving unit for turning the drive shaft in a rotating direction.

3. A blind having a plurality of rudder cords with each being formed of a pair of vertical strings and a plurality of lateral strings joining the vertical strings together and each of the vertical strings extending downwardly from a head box in a vertical direction, and a plurality of slats extending horizontally on the lateral strings of the rudder cords, retained in parallel with one another and adapted to be turned by operating the rudder cords to open and close the blind, the blind comprising:

openings formed in portions of each slat in a vicinity of the rudder cords; and drawings strings capable of being pulled, extending downwardly from the head box along the rudder cords, inserted into and extending through the openings in the slats and connected at lower end portions thereof to a portion of either one of the respective pairs of vertical strings of the rudder cords in positions of a selected height, wherein two systems of drawing strings extend downwardly along the rudder cords, the lower end portions of drawing strings of each system being joined to portions of different vertical strings of the rudder cords in positions of a same height.

4. A blind according to claim 3, wherein the head box is provided with one drive shaft supported therein and mounted with a plurality of reels around which the two systems of drawing strings are wound in opposite directions, and a driving unit for turning the drive shaft in a rotating direction.

5. A blind according to claim 3, wherein the head box is provided with two drive shafts supported therein and mounted with a plurality of reels around which the two systems of drawing strings are wound separately, and a driving unit for turning the drive shafts in a rotating direction respectively.

6. A blind having a plurality of rudder cords with each being formed of a pair of vertical strings and a plurality of lateral strings, joining the vertical strings together and each of the vertical strings extending downwardly from a head box in a vertical direction, and a plurality of slats extending horizontally on the lateral strings of the rudder cords, retained in parallel with one another and adapted to be turned by operating the rudder cords to open and close the blind, the blind comprising:

openings formed in portions of each slat in a vicinity of the rudder cords; and drawings strings capable of being pulled, extending downwardly from the head box along the rudder cords, inserted into and extending through the openings in the slats and connected at lower end portions thereof to portion of either one of the respective pairs of vertical strings of the rudder cords in positions of a selected height, wherein two systems of drawing strings extend downwardly along the rudder cords, the lower end portions of drawing strings of each system being joined to portions of different vertical strings of the rudder cords in positions of different heights.

7. A blind according to claim 6, wherein the head box is provided with one drive shaft supported therein and mounted with a plurality of reels around which the two systems of drawing strings are wound in the opposite directions, and a driving unit for turning the drive shaft in a rotating direction.

8. A blind according to claim 6, wherein the head box is provided with two drive shafts supported therein and mounted with a plurality of reels around which the two systems of drawing strings are wound separately, and a driving unit for turning the driving shafts in a rotating direction respectively.

* * * * *